United States Patent [19]

Leroux et al.

[11] Patent Number: 4,654,128

[45] Date of Patent: Mar. 31, 1987

[54] PROCESS FOR THE PREPARATION OF CERTAIN ORGANIC TRIHALOMETHYL DERIVATIVES

[75] Inventors: Francis Leroux, Brignais; Michel Jaccaud, Lyons, both of France

[73] Assignee: Atochem, France

[21] Appl. No.: 864,072

[22] Filed: May 16, 1986

[30] Foreign Application Priority Data

May 21, 1985 [FR] France ..... 85 07595

[51] Int. Cl.[4] ..... C25B 3/00

[52] U.S. Cl. ..... 204/59 F; 204/59 R

[58] Field of Search ..... 204/59 R, 59 F, 72

[56] References Cited

U.S. PATENT DOCUMENTS 3,871,975 3/1975 Nagase et al. ..... 204/59 F 4,524,031 6/1985 Millauer ..... 204/59 F

OTHER PUBLICATIONS

Brookes et al., J.C.S. Chem. Comm., 1974, pp. 323–324.

*Primary Examiner*—Arthur P. Demers

*Attorney, Agent, or Firm*—Sigalos & Levine

[57] ABSTRACT

A process for the preparation of an organic trihalomethyl derivative comprising electrolytically reducing a compound of the formula:

$$Cl_xF_{3-x}C—Br$$

in which x is equal to 0, 1 or 2, in a reaction medium also containing an electrophilic substrate which is void of electrochemical activity at the reduction potential of said compound, and a support electrolyte in an aprotic solvent for a time and at a temperature sufficient to form the desired organic trihalomethyl derivative.

9 Claims, No Drawings

PROCESS FOR THE PREPARATION OF CERTAIN ORGANIC TRIHALOMETHYL DERIVATIVES

BACKGROUND OF THE INVENTION

The invention relates to a process for the trifluoro(or chlorodifluoro or dichlorofluoro)methylation of electrophilic substrates void of electrochemical activity. In particular, the invention relates to the preparation of organic trihalo; i.e., trifluoro(or chlorodifluoro or dicholorofluoro)methyl derivatives, which can be used particularly as synthesis intermediates.

Several processes for introducing a trifluoromethyl group are already known, but, in general, these processes rely on materials which are not readily accessible and/or must be carried out in the presence of catalysts and/or chemical reducing agents. Thus, for example, the trifluoromethylation reaction may be carried out by a radical route from $CF_3I$ by initiating the reaction by raising the temperature or by irradiation with UV rays (J. Chem. Soc., 1953, p. 1199; U.S. Pat. Nos. 3,016,406 and 3,016,407). However, this method has not yet been applied industrially because access to trifluoromethyl iodide from trifluoroacetyl fluoride according to the scheme:

$$CF_3COF \longrightarrow CF_3COO^{\ominus}\,Ag^{\oplus} \xrightarrow{\Delta/I_2} CF_3I$$

is difficult and costly.

Complex compounds such as $$C_6H_5SO_2-\underset{\underset{CF_3}{|}}{N}-N=O$$

(Umemoto et al., Toyo Soda Kenkyu Hokoku 1983, 27(2), 69–73 and C.A. 100: 67911 z) or $CH_3Si-N=N-CF_3$ (Hartkopf et al., Angew. Chem. 1982, 94(6), 444 or C.A. 97: 127170 p) have also been proposed as trifluoromethylation agents.

The trifluoromethylation of olefins has also been performed by means of an electrochemical oxidation of the trifluoroacetate anion using a radical mechanism, as described by Brookes et al. (J. Chem. Soc. Chem. Commun. 1974, 323) and Renaud et al. (Can. J. Chem. 53, 1975, 529).

The trifluoromethylation reaction can also be carried out using $CF_3I$ or $CF_3Br$ in the presence of reducing agents and/or activators. Thus, Ishikawa (Chemistry Letters 1984, 517–520) uses zinc-based reducing agents and catalysts based on salts of nickel or of palladium which are complexed with phosphines. The use of zinc, which gives rise to polluted effluents, makes this method unattractive on an industrial scale.

SUMMARY OF THE INVENTION

It has now been found that the compounds of the formula:

$$Cl_xF_{3-x}C\text{-}Br \qquad (I)$$

in which x is equal to 0, 1 or 2, can be directly reduced electrochemically and that a convenient source of $Cl_xF_{3-x}C^{\ominus}$ anions, leading to nucleophilic addition reactions in the presence of electrophilic substrates void of electrochemical activity, is thereby obtained simply (without a chemical reducing agent such as zinc) and from readily accessible compounds.

The present invention consequently relates to a process for the preparation of organic trihalomethyl derivatives; i.e., trifluoro(or chlorodifluoro or dichlorofluoro)methyl derivatives, characterized in that a compound of formula (I) is reduced electrochemically in the presence of an electrophilic substrate void of electrochemical activity and a support electrolyte in an aprotic solvent.

DETAILED DESCRIPTION

As used herein, the phrase "electrophilic substrate void of electrochemical activity", means any electron-withdrawing organic compounds which, under the operating conditions, has a reduction potential which is more negative than the potential at which the operation is carried out. As examples of such substrates there may be mentioned, more particularly, carbon dioxide; aldehydes such as formaldehyde and acetaldehyde; ketones such as acetone and benzophenone, and activated olefins (that is to say containing at least one electron-withdrawing group) such as allyl alcohol or methyl acrylate.

Provided that it has a reduction potential which is more negative than that at which the operation is carried out, and that it is sufficiently soluble in the medium, the support electrolyte, whose function is to be responsible for conducting the current, may be chosen from any inorganic or organic salts which are known to act in this way (cf., for example, Organic Electrochemistry by M. M. Baizer, 1973, p. 227–230) and, more especially, from alkali metal (preferably lithium) or tetraalkylammonium ($C_1C_4$ alkyl radicals) bromides, chlorides, perchlorates or arylsulphonates. The quantity of support electrolyte in the aprotic solvent may range from about 0.01 mole/liter up to saturation; the support electrolyte is preferably used at a concentration of about 0.1 to 1 mole per liter of aprotic solvent.

In accordance with the present invention, the reaction may be performed in any aprotic solvent or a mixture of such solvents, provided that its cathodic limit is lower than the reduction potential of the compound (I). It is preferable, however, to choose it from amides, such as dimethylformamide (DMF), dimethylacetamide (DMA); N-methylpyrrolidone (NMP); hexamethylphosphorotriamide (HMPT); sulphoxides, such as dimethyl sulphoxide (DMSO); nitriles, such as acetonitrile (ACN); and ethers, such as tetrahydrofuran (THF). Pyridine, nitromethane, nitrobenzene, propylene carbonate, 1,2-dimethoxyethane, methylene chloride and tetrahydrothiophene dioxide can be mentioned as other examples of aprotic solvents.

In the process according to the invention, the cathode, which forms the working electrode, can be an electrode made of carbon, graphite, platinum, nickel, gold, lead or mercury. The anode may be identical to the working electrode, but may also consist of any conventional electrode material, so long as it is inert under the reaction conditions.

The electrochemical reduction according to the present invention may be performed in cells of various conventional types. Although the operation may be carried out in a single-compartment cell, it is preferred to conduct the operation in a two-compartment cell, to avoid free circulation between the cathode and the anode; the separator is generally made of an inert material; for example, porcelain, sintered glass, or an ion exchange membrane.

The operation may be conducted under constant-potential or constant-current control and is preferably carried out at the reduction potential of the compound of formula (I) under the operating conditions, it being possible to determine this potential in a manner which is known per se by polarography or by cyclic voltage potentiometry.

The temperature region in which the electrochemical reduction according to the invention can be carried out may vary within wide limits, depending on the nature of the substrates and solvents employed. In general, the operation is carried out at a temperature which can range from about −15° C. up to the boiling point of the aprotic solvent or even at a higher temperature when the operation is carried out under pressure (from 0 to 50 bars). However, it is preferable to operate at a temperature between about 0° and 80° C.

The molar ratio of the electrophilic substrate to the compound of formula (I) may vary from about 1 to 20 and is advantageously between about 3 and 10. It is preferable to operate with the reaction medium saturated with the compound of formula (I), it being possible for this saturation to be maintained during the operation, if appropriate, by continuous or periodic addition of compound (I).

The product formed may be isolated by any conventional method, especially by liquid-liquid extraction and/or by distillation, and the like.

The invention will be further described in connection with the following examples which are set forth for purposes of illustration only. These examples have been performed by using, as an electrolysis cell with separate compartments, a 1-liter glass reactor equipped with a reflux device, an energetic stirring system, a jacket and the required tubing for adding the reactants. Except where indicated otherwise, the work was done with a graphite cathode (a 30 $cm^2$ rectangular plate) and a platinum anode (10 $cm^2$ disc), using a perfluorinated Nafion® membrane, marketed by the Du Pont de Nemours Company as a separator and controlling the electrolysis potential with a saturated calomel reference electrode (SCE).

EXAMPLE 1

40 ml of a solution containing 0.1 mole/liter of $LiClO_4$ in DMF are introduced as the anolyte into the anode compartment of the cell. In addition, 550 ml of a solution containing 0.055 mole of $LiClO_4$ and 0.55 mole of acetaldehyde in DMF are introduced as the catholyte into the cathode compartment. The reactor is closed, stirring is commenced and the reactor is cooled to 3° C. by circulating a mixture of water and glycol (2/1 weight ratio) through the jacket, and then the catholyte is saturated with bromotrifluoromethane.

The voltage is applied and maintained for 5 hours at a cathode current density of 1 A/$dm^2$, while 2.2 Nl/h of $CF_3Br$ are introduced by bubbling into the catholyte. The electrolysis potential is −2.00 volts/SCE.

When the electrolysis is finished, the reaction solution is hydrolyzed in an acid medium (HCl, pH 1), is neutralized with sodium hydroxide, and sodium chloride is added until saturation is obtained. The mixture is then extracted with ethyl ether and the extract dried over sodium sulphate. After evaporating off the ether and distilling, 1,1,1-trifluoro-2-propanol (b.p. 78° C.) is obtained, whose structure has been identified by NMR and by mass spectrography in tandem with gas phase chromatography.

The current yield, that is to say, the ratio of the mass of the product identified by analysis to the theoretical mass, is 35%.

EXAMPLE 2

Carbon dioxide is used as an electrophilic substrate and the operation is carried out under the following conditions:

| | |
|---|---|
| Electrolysis potential: | −1.9 volts/SCE |
| Current density: | 0.1 A/$dm^2$ |
| Temperature: | 20° C. |
| Time: | 6 hours |
| Anolyte: | 40 ml of a solution containing 0.15 mole/l of LiCl in DMF. |
| Catholyte: | 550 ml of a solution containing 0.15 mole/l of LiCl in DMF. Before the electrolysis is commenced, this solution is saturated with $CF_3Br$ and with $CO_2$; 2.2 Nl/h of $CF_3Br$ and 2.2 Nl/h of $CO_2$ (molar ratio = 1) are then added during the operation. |

The reaction solution is then hydrolyzed in an acid medium and is then subjected to distillation. The water/trifluoroacetic acid azeotrope distills over at 105.5° C. at atmospheric pressure.

In this manner, a 52% current yield of trifluoroacetic acid is obtained, whose structure has been identified by $^{19}F$ NMR.

EXAMPLES 3 TO 9

The following table gives a summary of seven operations performed by applying the method of Example 1 to other solvents, other electrolytes and/or other substrates. The abbreviation TBAB denotes tetrabutylammonium bromide. Except for the temperature shown in the fifth column of the table and for Example 3, in which a rectangular platinum plate (30 $cm^2$), was used as the cathode, the remaining operating conditions are the same as in Example 1. All the products have been identified by NMR.

| Ex. | Substrate | Solvent | Support electrolyte | Temp. (°C.) | PRODUCT | Current yield |
|---|---|---|---|---|---|---|
| 3 | $CH_3CHO$ | DMF | TBAB | 20 | $CH_3CH(OH)CF_3$ | 25% |
| 4 | " | " | " | " | " | 23% |
| 5 | " | DMSO | " | " | " | 20% |
| 6 | " | NMP | " | " | " | 20% |
| 7 | " | THF/HMPT[a] | " | " | " | 32% |
| 8 | HCHO[b] | DMF | $LiClO_4$ | 60 | $CF_3CH_2OH$ | 10% |
| 9 | $CO_2$ | ACN | LiCl | 20 | $CF_3CO_2H$ | 20% |

[a]50/50 volume mixture
[b]as paraformaldehyde

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A process for the preparation of an organic trihalomethyl derivative comprising electrolytically reducing a compound of the formula:

$$Cl_xF_{3-x}C—Br$$

in which x is equal to 0, 1 or 2, in a reaction medium also containing an electrophilic substrate which is void of electrochemical activity at the reduction potential of said compound, and a support electrolyte in an aprotic solvent for a time and at a temperature sufficient to form the desired organic trihalomethyl derivative.

2. The process of claim 1, in which said compound is bromotrifluoromethane.

3. The process of claim 1 or 2 in which the electrophilic substrate is carbon dioxide, an aldehyde, ketone, or an activated olefin; the support electrolyte is a lithium or tetraalkylammonium salt; and the aprotic solvent is selected from an amide, sulphoxide, nitrile, ether, or mixture thereof.

4. The process of claim 1 or 2, in which the cathode is made of carbon, graphite, platinum, nickel, gold, lead, or mercury.

5. The process of claim 1 or 2, in which the cathode and the anode are separated by an ion exchange membrane, porcelain, or sintered glass.

6. The process of claim 1 or 2, in which the quantity of support electrolyte in the aprotic solvent ranges from about 0.01 mole/liter up to saturation.

7. The process of claim 1 or 2, in which the molar ratio of electrophilic substrate to the compound of formula (I) is between about 1 to 20.

8. The process of claim 1 or 2, in which the reaction medium is saturated with said compound.

9. The process for the preparation of an organic trifluoromethyl derivative comprising forming a reaction medium consisting essentially of bromotrifluoromethane in an amount sufficient to saturate said medium; an electrophilic substrate selected from carbon dioxide, an aldehyde, ketone, or an activated olefin in a molar ratio with respect to said bromotrifluoromethane between about 3 to 10; a support electrolyte selected from lithium or a tetraalkylaluminium salt in an amount in an aprotic solvent ranging from about 0.1 to 1 mole/liter; and an aprotic solvent selected from an amide, sulphoxide, nitrile, ether, or mixture thereof, and electrochemically reducing and bromotrifluoromethane in said medium at a temperature of from about 0° to 80° C. in the presence of a cathode made of carbon, graphite, platinum, nickel, gold, lead, or mercury.

* * * * *

UNITED STATES PATENT AND TRADEMARK OFFICE

CERTIFICATE OF CORRECTION

PATENT NO. : 4,654,128

DATED : March 31, 1987

INVENTOR(S) : Francis Leroux et al.

It is certified that error appears in the above-identified patent and that said Letters Patent is hereby corrected as shown below:

Column 6, line 27, Claim 9, "and" should read -- said --.

Signed and Sealed this

Eighteenth Day of August, 1987

*Attest:*

*Attesting Officer*

DONALD J. QUIGG

*Commissioner of Patents and Trademarks*